US008491402B2

(12) United States Patent
Yeh et al.

(10) Patent No.: US 8,491,402 B2
(45) Date of Patent: Jul. 23, 2013

(54) CONTROL METHOD AND SWING MECHANISM FOR AN INFANT AND CHILD SWING

(75) Inventors: Chuan-Kun Yeh, Tainan (TW); Kuang-Neng Cheng, Chiayi County (TW)

(73) Assignee: Lerado (Zhong Shan) Industrial Co., Ltd., Zhong Shan City, Guang Dong Province (CN)

( * ) Notice: Subject to any disclaimer, the term of this patent is extended or adjusted under 35 U.S.C. 154(b) by 308 days.

(21) Appl. No.: 13/090,835

(22) Filed: Apr. 20, 2011

(65) Prior Publication Data

US 2011/0256943 A1 Oct. 20, 2011

(30) Foreign Application Priority Data

Apr. 20, 2010 (CN) ..... 2010 1 0153106

(51) Int. Cl.
*A63G 9/16* (2006.01)
*A63G 9/00* (2006.01)

(52) U.S. Cl.
USPC ..... 472/119

(58) Field of Classification Search
USPC ..... 472/118–125; 297/273, 274, 284, 297/285
See application file for complete search history.

(56) References Cited

U.S. PATENT DOCUMENTS 6,022,277 A * 2/2000 Jankowski ..... 472/119
6,339,304 B1 * 1/2002 Allison et al. ..... 318/443
7,905,791 B2 * 3/2011 Guang et al. ..... 472/119

* cited by examiner

*Primary Examiner* — Kien Nguyen
(74) *Attorney, Agent, or Firm* — Morris Manning & Martin, LLP; Tim Tingkang Xia, Esq.

(57) ABSTRACT

A swing mechanism for an infant and child swing includes a swing arm, a swing angle adjustment assembly and a PWM motor driving unit. The swing arm is driven by a motor for swinging forth and back in a first direction and a second direction. The swing angle adjustment assembly includes a knob, a connecting arm and a sensor, wherein the knob is associated with the sensor by the connecting arm thereby moving the sensor to a reference point at a swing height of the infant and child swing by turning the knob. The PWM motor driving unit inputs an adjustable voltage to the motor for driving the swing arm, and interrupting the adjustable voltage thereafter when the swing arm arrived the reference point in the first direction. A method for controlling the infant and child swing uses the swing mechanism as described above.

17 Claims, 7 Drawing Sheets

CONTROL METHOD AND SWING MECHANISM FOR AN INFANT AND CHILD SWING

CROSS-REFERENCE TO RELATED APPLICATIONS

This non-provisional application claims benefits and priority under 35 U.S.C. §119(a) on Chinese Patent Application No. CN/201010153106.7 filed in The People's Republic of China on Apr. 20, 2010, which is incorporated herein by reference in its entirety.

BACKGROUND OF THE INVENTION

1. Field of the Invention

The present invention relates generally to a control method and swing mechanism for an infant and child swing, especially to a swing can move freely by inertia force and gravity force after passed a reference point in a first direction and before returned to the reference point for saving energy.

2. Description of the Related Art

Traditional powered swing either for baby or child, has an example disclosed in U.S. Pat. No. 5,846,136, which uses a cam-like member associated with a spring to drive the swing arm thereof forth and back. However, the mechanical energy is always wasted too much between the ineffective vibrations of the spring. The preselected swing amplitude may also not be obtained with accurate and consistent.

U.S. Pat. No. 5,846,136 provided a method for controlling the amplitude of a swing accurately and consistently, which includes the steps of monitoring the current swing amplitude, generating a swing amplitude signal which is representative of said current swing amplitude, comparing the current swing amplitude when the swing changes direction with a preselected maximum swing amplitude; and, adjusting the output power of the motor when the current swing amplitude is not substantially equal to the preselected maximum swing amplitude. The swing cycle is monitored and the energy produced by the swing motor to drive the swing is reviewed for adjustment no less frequently than once each swing cycle, thereby improving the accuracy and consistency of swing height. However, as the swing is used for amusement not for industrial instrument, the control method of U.S. Pat. No. 5,846,136 is too complex to a child or baby swing.

SUMMARY OF THE INVENTION

For simplifying the swing mechanism and the control method, and further to save energy by fully utilizing the inertia force and gravity force in the pendulum like swing movement, the present invention provides a novel control method and swing mechanism for infant and child swing.

The swing mechanism according to the present invention includes a swing arm, a swing angle adjustment assembly and a PWM motor driving unit. The swing arm driven by a motor for swinging forth and back in a first direction and a second direction.

The swing angle adjustment assembly includes a knob, a connecting arm and a sensor, wherein the knob is associated with the sensor by the connecting arm thereby moving the sensor to a reference point at a swing height of the infant and child swing by turning the knob. The PWM motor driving unit inputs an adjustable voltage to the motor for driving the swing arm, and interrupting the adjustable voltage thereafter when the swing arm arrived the reference point in the first direction.

The control method according to the present invention includes the steps of: (1) moving the sensor to a reference point; (2) driving the swing arm toward the reference point in a first direction; (3) generating a signal when the swing arm arrived and detected by the sensor at the reference point; (4) permitting the infant and child swing to move freely and upwardly by the inertial force after the swing arm passed through the reference point; (5) driving the swing arm in a second direction after the swing arm swung back and passed the reference point; and (6) repeating the steps of (2) to (5) after the infant and child swing being swung back from the second direction to the first direction.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention; examples of which are illustrated in the accompanying drawings.

Figure 1:
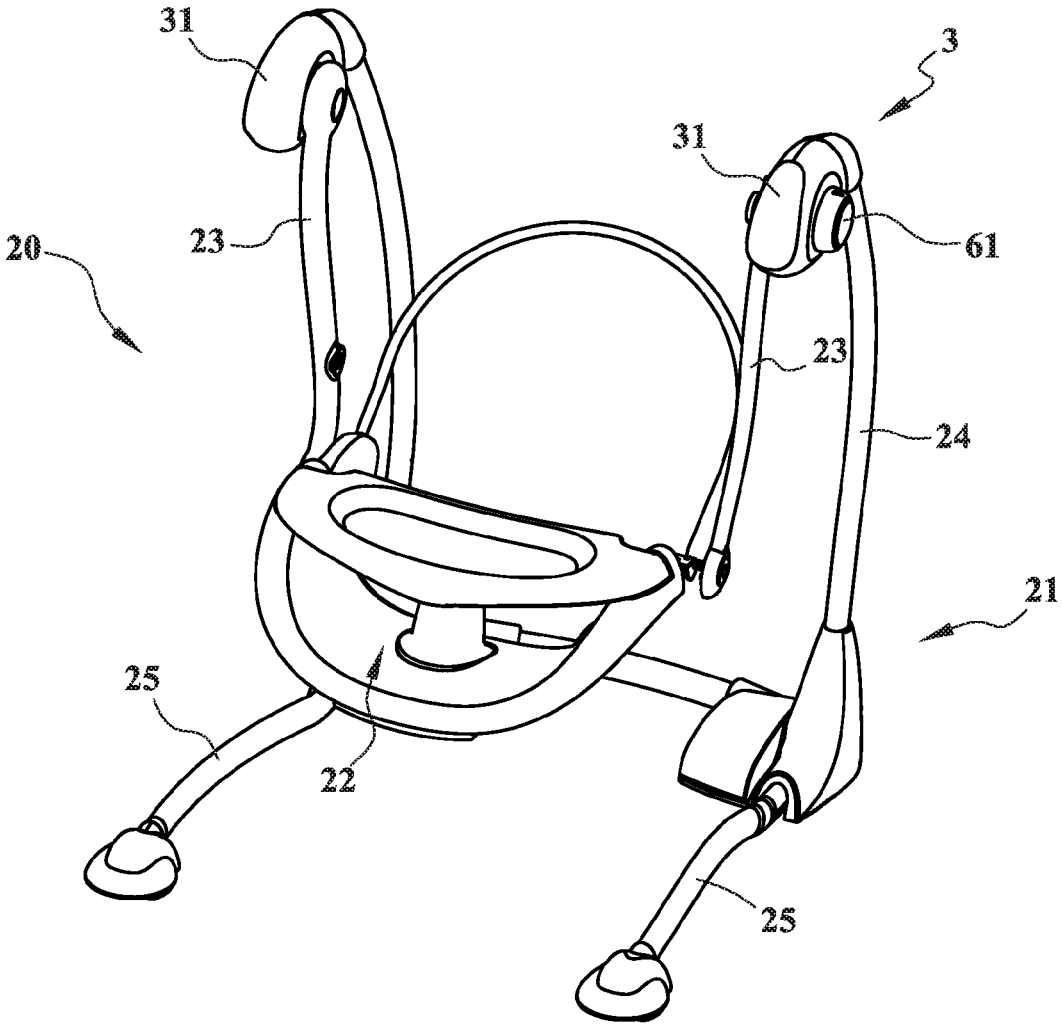
FIG. 1 is a perspective view showing an infant and child swing which equipped with a swing mechanism according to the present invention.

Referring to FIG. 1, an infant and child swing 20 equipped with the swing mechanism 3 of the present invention, comprises a foldable frame 21 including an upper support member 24 and a lower support member 25, a baby and child support member 22 suspended to the upper end of the upper support member 24 through a swing arm 23. The baby and child support member 22 may be embodied as a cradle, small bed, seat or the like having an accommodation space therein. The swing mechanism 3 is operatively mounted on the top portion of the upper support member 24 for driving the swing arm 23 to swing forth and back similar to a pendulum.

Referring to FIGS. 2 to 7, a prefer embodiment of the swing mechanism 3 according to the present invention comprises a swing arm 23, a swing angle adjustment assembly 6 and a PWM motor driving unit 8.

The swing arm 23 can be driven by a motor 32 for swinging forth and back in a first direction and a second direction. For enlarging the power output from the motor 32, the swing mechanism 3 is preferably further included a gear reduction unit 33 for transmitting the power output from the motor 32 to a driving shaft 34 for driving the swing arm 23 forth and back, as being illustrated in FIGS. 2 and 3.

The swing angle adjustment assembly 6 as set forth above, includes a knob 61, a connecting arm 62 and a sensor 63, wherein the knob 61 is associated with the sensor 63 by the connecting arm 62 thereby moving the sensor 63 to a reference point at a swing angle (θ1、θ2、θ3、θ4 or θ5) of the infant and child swing 20 by turning the knob 61.

Figure 2:
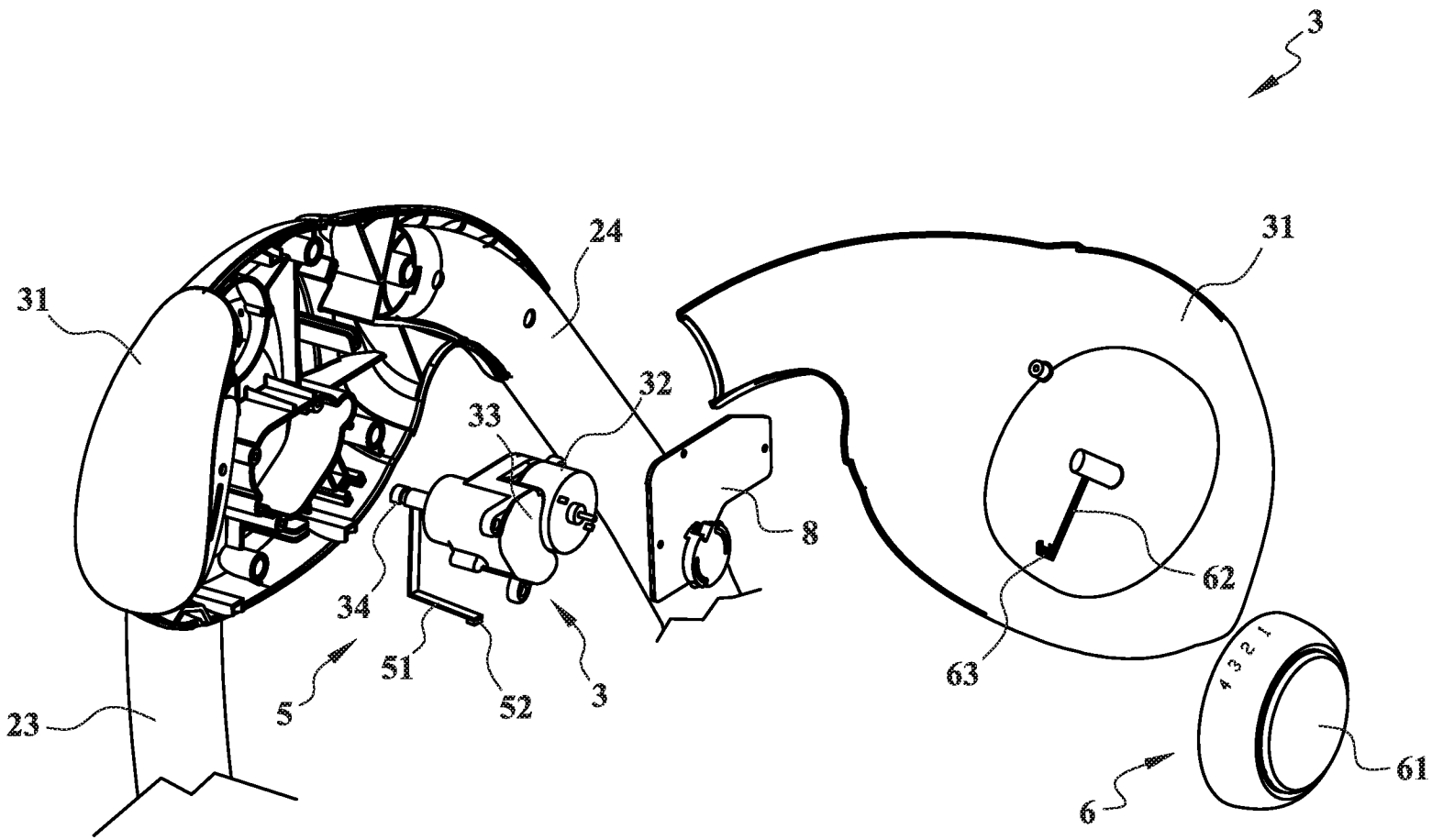
FIG. 2 is an exploded perspective view showing a swing mechanism according to the present invention.
Figure 3:
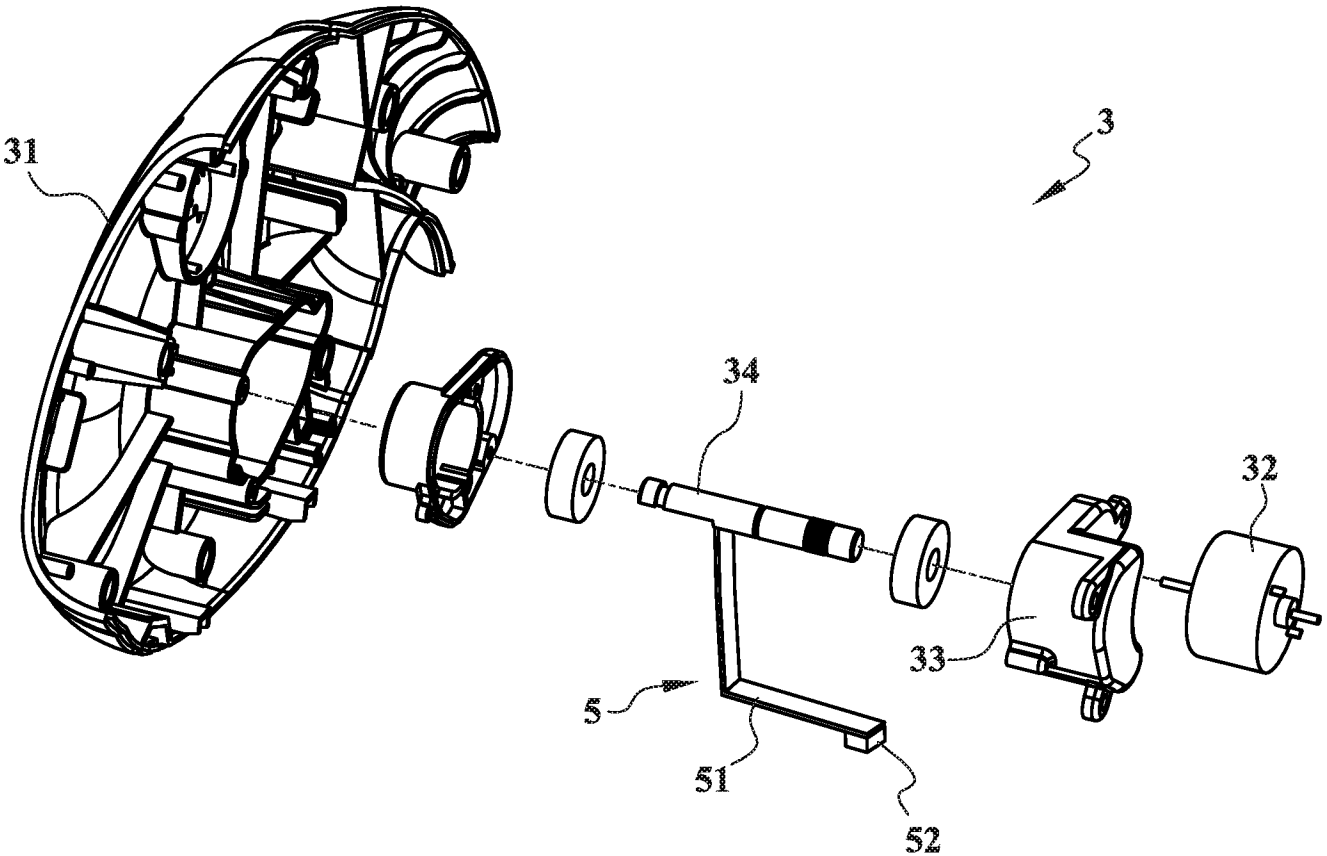
FIG. 3 is another exploded perspective view illustrating the swing mechanism in more detailed.
Figure 4:
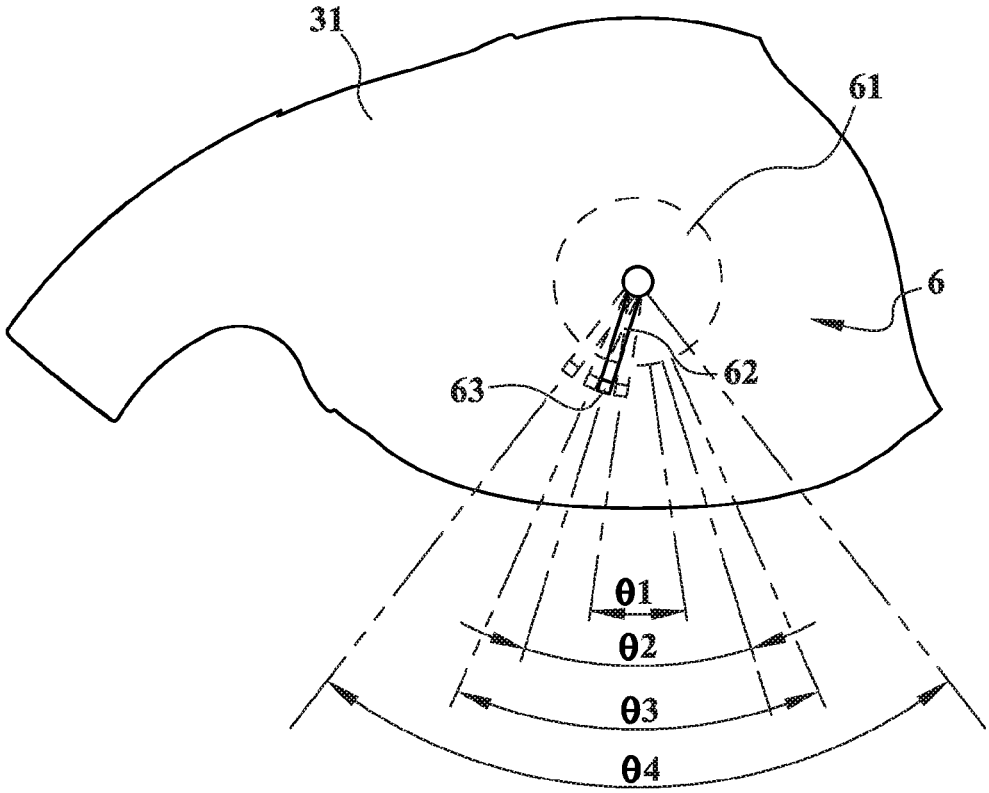
FIG. 4 is a side schematic view illustrating a shroud of the swing mechanism which may be formed with a scale mark for indicating a variety of reference points relative to different selective swing height or swing angles of the infant and child swing.
Figure 5:
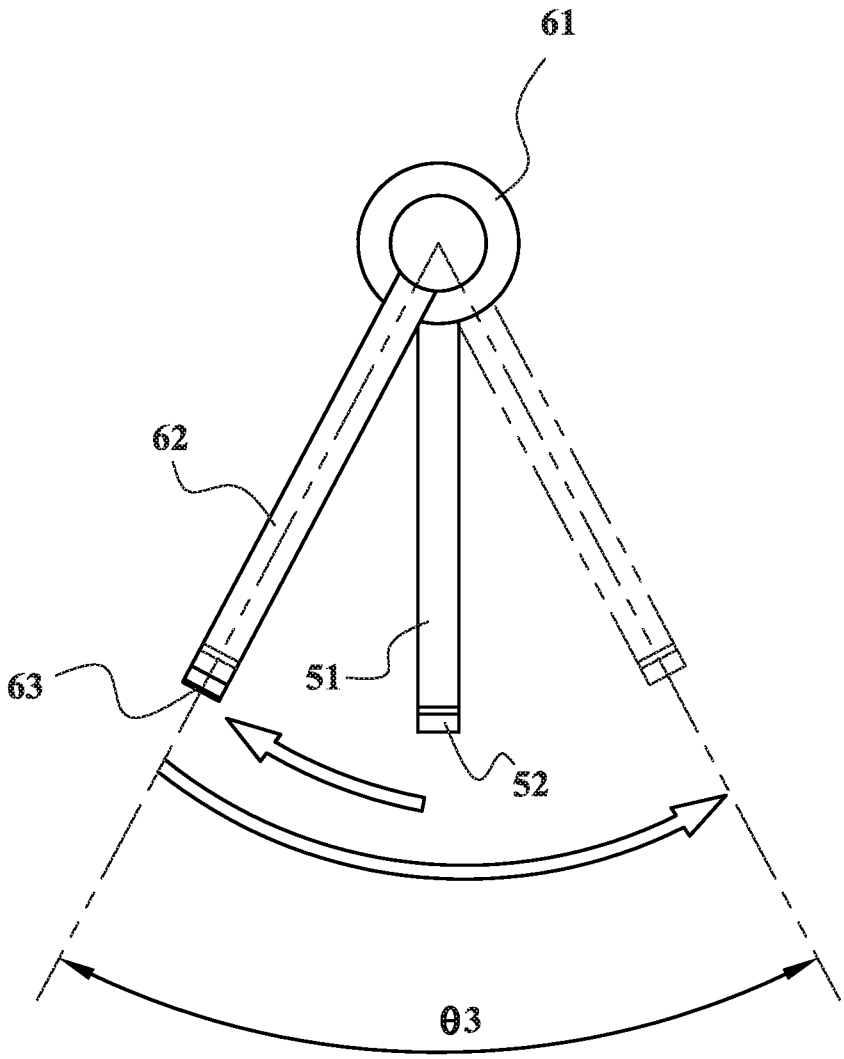
FIG. 5 is a schematic view illustrating the operation of moving the sensor to a reference point at a selected swing height or swing angle.

As shown in FIGS. 2, 4 and 5, the swing mechanism 3 may further include a shroud 31 for pivotally installing the knob 61 thereon. A scale mark may be formed or printed on the knob 61 and the shroud 31 so as to indicate a variety of reference points. Each reference point represents a swing angle (θ1、θ2、θ3、θ4 or θ5), a swing height, or swing amplitude of the infant and child swing 20.

An indicating unit 5 may be installed within the shroud 31. The indicating unit 5 includes an indicator 51 driven by the driving shaft 34 thereby following the swing arm 23 to swing forth and back. The indicator 51 may be attached on the swing arm 23 or formed as a L-shaped arm with a light shelter or light reflector at the distal end thereof, and the sensor 63 may be embodied as a photoelectric switch which can generate a signal to the PWM motor driving unit 8 when the light shelter or light reflector shades or reflects a light on the sensor 63.

Figure 7:
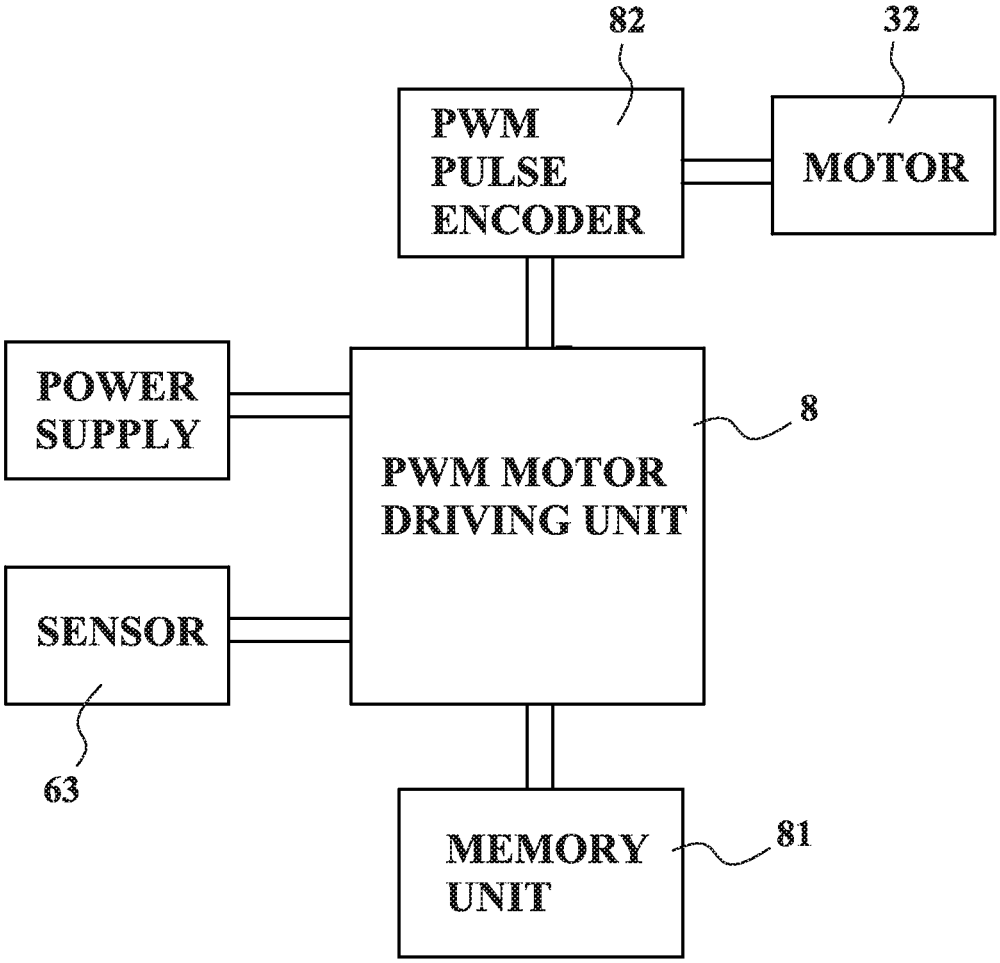
FIG. 7 is a schematic view exampling a PWM motor driving unit 8 according to the present invention.

Referring to FIG. 7, the PWM motor driving unit 8 connects with the sensor 63 and the motor 32, and has a PWM pulse encoder 82 for outputting an adjustable voltage with pulse width modulation. The PWM motor driving unit 8 may input the adjustable voltage to the motor 32 for driving the swing arm 23, and interrupt the adjustable voltage after the swing arm 23 arrived the reference point in the first direction; i.e, when the PWM motor driving unit 8 received the signal from the sensor 63, the power output from the motor 32 will then be stopped and let the swing arm 23 moving freely forward and upwardly by its inertia force until the gravity force pulls the infant and child swing 20 to the second direction.

For making sure of the infant and child swing 20 being come back from the first direction to the second direction, it is preferably to make the sensor 63 generating a second signal when the swing arm 23 come back the reference point in second direction; when the PWM motor driving unit 8 received the second signal from the sensor 63, inputs an opposite adjustable voltage to the motor 32 to drive the swing arm 23 moving in the second position for less than half time length of the swing cycle. For achieve this swing control, the PWM motor driving unit 8 may also be equipped with a memory unit 81 for recording or store each time length of the swing cycles.

For simplifying the swing control, in some prefer embodiment, the PWM motor driving unit 8 terminates the adjustable voltage to the motor 32 for 25 milli-second (ms) to 1 second (s) after being received the first signal from the sensor 63 (without waiting the second signal generate from the sensor 63), and then inputs opposite adjustable voltage to the motor 32 for driving the swing arm 23 in the second direction for ¼ to ½ time length of the swing cycles.

Figure 6:
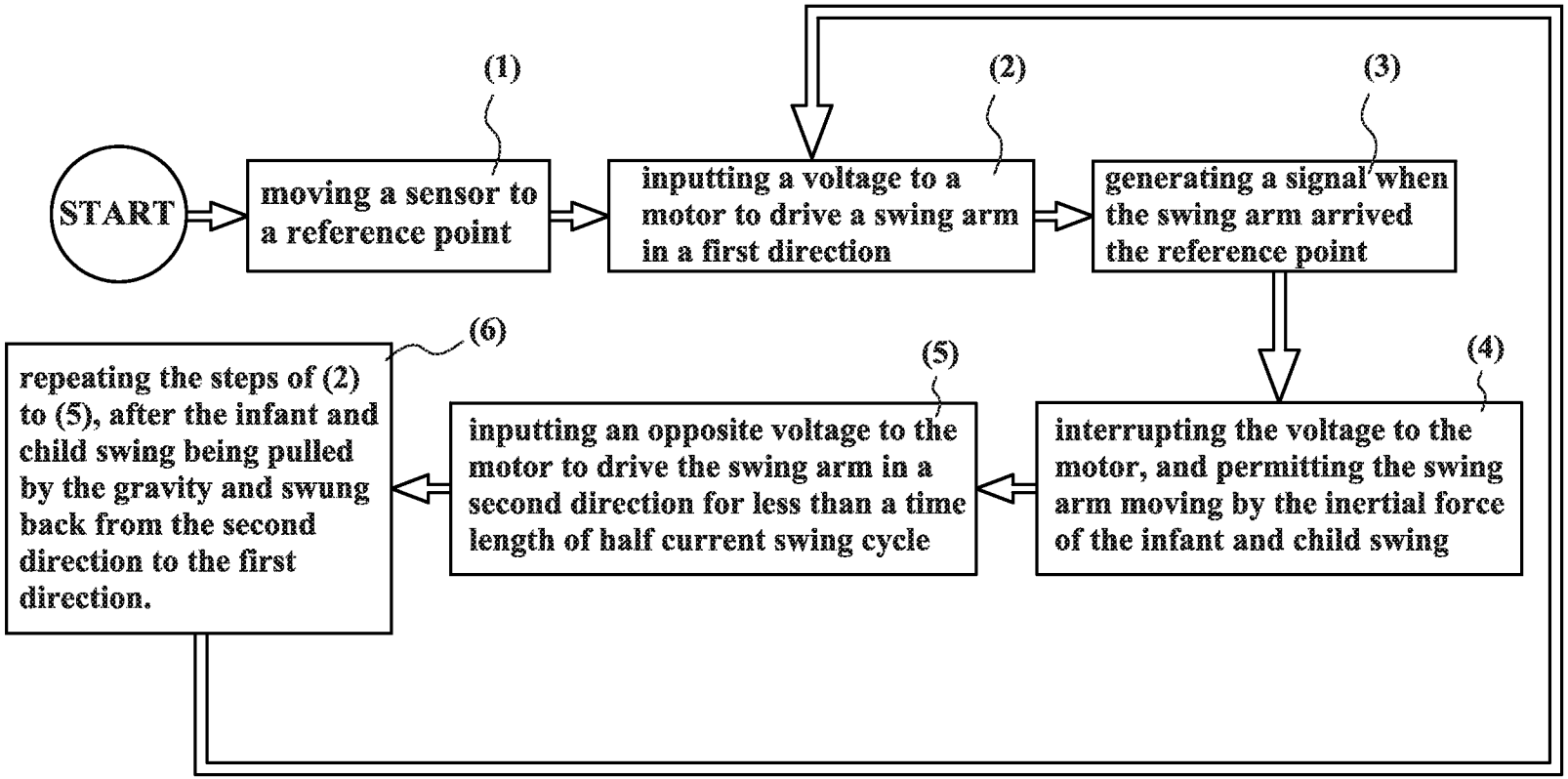
FIG. 6 is a schematic diagram showing the steps of the control method according to the present invention.

As being illustrated in FIG. 6, the control method according to the present invention, comprises the steps of:

(1). moving a sensor 63 to a reference point which represents a selected swing angle (θ1、θ2、θ3、θ4 or θ5), a swing height, or swing amplitude of the infant and child swing 20, as set forth above.

(2). inputting a voltage to a motor 32 to drive a swing arm 23 of the infant and child swing 20 for moving the swing arm 23 toward the reference point in a first direction;

(3). generating a signal when the swing arm 23 arrived and detected by the sensor 63 at the reference point;

(4). interrupting the voltage to the motor, and permitting the swing arm 23 to move freely and upwardly by the inertial force of the infant and child swing 20;

(5). inputting an opposite voltage to the motor 32 to drive the swing arm 23 in a second direction for less than a time length of half current swing cycle, after the swing arm 23 being pulled by the gravity force and swung back to the second direction; and (6). repeating the steps of (2) to (5), after the infant and child swing 20 being pulled by the gravity and swung back from the second direction to the first direction.

It would be appreciated that the sensor 63 is moved by turning the knob 61 of the swing angle adjustment assembly 6 as shown in FIGS. 1 and 2 which is preferably mounted on the top end of the infant and child swing 20.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A control method for an infant and child swing, comprising the steps of:

(1) moving a sensor to a reference point at a swing angle of the infant and child swing;

(2) inputting a voltage to a motor to drive a swing arm of the infant and child swing for moving toward the reference point in a first direction;

(3) generating a signal when the swing arm arrived and detected by the sensor at the reference point;

(4) interrupting the voltage to the motor, and permitting the swing arm to move freely and upwardly by the inertial force of the infant and child swing;

(5) inputting an opposite voltage to the motor to drive the swing arm in a second direction for less than a time length of half current swing cycle, after the swing arm being pulled and swung back by the gravity force to the second direction; and (6) repeating the steps of (2) to (5), after the infant and child swing being pulled by the gravity and swung back from the second direction to the first direction.

2. The control method for an infant and child swing according to claim 1, wherein the sensor is moving by turning a knob mounted on the infant and child swing.

3. The control method for an infant and child swing according to claim 1, wherein the infant and child swing is swinging freely and upwardly by an inertial force of the infant and child swing in the second direction after the voltage is interrupted.

4. The control method for an infant and child swing according to claim 3, wherein the swing arm is swinging back from the second direction to the first direction by the gravity force of the infant and child swing.

5. A swing mechanism for an infant and child swing, comprising:

a swing arm driven by a motor for swinging forth and back in a first direction and a second direction;

a swing angle adjustment assembly, including a knob, a connecting arm and a sensor, wherein the knob is associated with the sensor by the connecting arm thereby moving the sensor to a reference point at a swing angle of the infant and child swing by turning the knob;

a PWM motor driving unit for inputting an adjustable voltage to the motor to drive the swing arm, and interrupt the adjustable voltage when the swing arm arrived the reference point in the first direction.

6. The swing mechanism for an infant and child swing according to claim 5, wherein the knob is mounted on a shroud; the shroud and the knob each has a scale mark for indicating a variety of reference points each represents a swing angle.

7. The swing mechanism for an infant and child swing according to claim 5, further including a gear reduction unit for transmitting a power output from the motor to a driving shaft for driving the swing arm forth and back.

8. The swing mechanism for an infant and child swing according to claim 7, further included an indicator driven by the driving shaft thereby following the swing arm to swing forth and back.

9. The swing mechanism for an infant and child swing according to claim 8, wherein the indicator is attached on the swing arm.

10. The swing mechanism for an infant and child swing according to claim 8, wherein the sensor is a photoelectric switch, and the indicator is a light shelter.

11. The swing mechanism for an infant and child swing according to claim 8, wherein the sensor is a photoelectric switch, and the indicator is a light reflector.

12. The swing mechanism for an infant and child swing according to claim 5, wherein the sensor generates a signal to the PWM motor driving unit when the swing arm arrived the reference point in the first direction.

13. The swing mechanism for an infant and child swing according to claim 12, wherein the PWM motor driving unit terminates the adjustable voltage to the motor when received the signal from the sensor.

14. The swing mechanism for an infant and child swing according to claim 5, wherein the sensor generates a second signal to the PWM motor driving unit when the swing arm swung back in the second direction and arrived the reference point.

15. The swing mechanism for an infant and child swing according to claim 14, wherein the PWM motor driving unit inputs an opposite adjustable voltage to the motor when received the second signal from the sensor thereby driving the swing arm in the second direction.

16. The swing mechanism for an infant and child swing according to claim 14, wherein the PWM motor driving unit terminates the adjustable voltage to the motor for ms after being received the first signal from the sensor, and then inputs an opposite adjustable voltage to the motor for driving the swing arm in the second direction.

17. The swing mechanism for an infant and child swing according to claim 16, further includes a memory unit for storing a time length of swing cycle of the infant and child swing, and the PWM motor driving unit inputs the opposite adjustable voltage to the motor in the second direction for less than half time length of current swing cycle.

* * * * *